US009743173B2

(12) United States Patent
Nakagawa et al.

(10) Patent No.: US 9,743,173 B2
(45) Date of Patent: Aug. 22, 2017

(54) SIGNAL PROCESSING DEVICE, SIGNAL PROCESSING METHOD, AND COMPUTER PROGRAM

(71) Applicant: SONY CORPORATION, Tokyo (JP)

(72) Inventors: Toshiyuki Nakagawa, Kanagawa (JP); Junya Suzuki, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/643,077

(22) Filed: Mar. 10, 2015

(65) Prior Publication Data

US 2015/0271590 A1 Sep. 24, 2015

(30) Foreign Application Priority Data

Mar. 19, 2014 (JP) ..... 2014-056281

(51) Int. Cl.
*H04R 25/00* (2006.01)
*H04R 1/10* (2006.01)

(52) U.S. Cl.
CPC ..... *H04R 1/1091* (2013.01); *H04R 2460/13* (2013.01)

(58) Field of Classification Search
CPC ... A61B 5/04845; A61B 5/121; A61B 5/7257; H04R 29/001; H04R 1/1016; H04R 29/00
USPC ..... 381/312, 57, 58, 151; 600/25, 544, 559
See application file for complete search history.

(56) References Cited

U.S. PATENT DOCUMENTS 9,100,758 B2 * 8/2015 Adachi ..... A61B 5/04845
2011/0301729 A1 * 12/2011 Heiman ..... H04S 7/301 700/94

FOREIGN PATENT DOCUMENTS

WO 2012/063423 A1 5/2012

* cited by examiner

*Primary Examiner* — Davetta W Goins
*Assistant Examiner* — Phylesha Dabney
(74) *Attorney, Agent, or Firm* — Chip Law Group

(57) ABSTRACT

There is provided a signal processing device including a first reproduced sound outputting section configured to cause a first reproduced sound providing section to provide a first reproduced sound, a second reproduced sound outputting section configured to cause a second reproduced sound providing section to provide a second reproduced sound, a comparison result obtaining section configured to obtain a result of comparison between the first reproduced sound and the second reproduced sound, and a correcting section configured to generate, based on the obtained result of comparison, a signal for correcting an output feature of the second reproduced sound from the second reproduced sound outputting section.

12 Claims, 6 Drawing Sheets

SIGNAL PROCESSING DEVICE, SIGNAL PROCESSING METHOD, AND COMPUTER PROGRAM

CROSS REFERENCE TO RELATED APPLICATIONS

This application claims the benefit of Japanese Priority Patent Application JP 2014-056281 filed Mar. 19, 2014, the entire contents of which are incorporated herein by reference.

BACKGROUND

The present disclosure relates to a signal processing device, a signal processing method, and a computer program.

Bone conduction speakers for listening bone conduction sounds, which are sounds being transmitted via bone conduction, have been known. In general, bone conduction speakers are configured to allow a listener to listen to reproduced sounds by listening to bone conduction sounds generated by vibration of a vibration section of the bone conduction speaker, which vibration section is attached to a location such as the vicinity of the listener's temple.

SUMMARY

Unlike aerial conduction speakers which are universally configured to be used by attaching the speakers to an auricle or acoustic dust, bone conduction speakers are not always specific as to an attaching position to which a vibration section of the bone conduction speakers is attached. Users of such bone conduction speakers would find that, for example, in order to listen to sounds in a high sound range more strongly, temple is not always a good place to attach the vibration section, but tragus would be a better place than temple. Differences in the attaching positions of the bond-conduction speakers would cause the bone conduction speakers to output sounds with different features over an entire sound range. For example, when there is a remarkable difference in the feature of the output sounds in a high sound range, the feature of the sounds the user listen to would be different from genuine features the outputs sounds are supposed to have.

For instance, WO 2012/63423 discloses a technique for adjusting a level of amplification of sounds according to audibility of a user individually by comparing two sounds. However, a sufficient technique for correcting feature of output sounds has not been established for an audio system such as bone conduction speakers in which features of output sounds to be listened would vary according to where the attaching position is.

The present disclosure suggests a novel and improved signal processing device, signal processing method, and computer program, each of which makes it possible to listen suitable sounds regardless of where the attaching position is, by appropriately correcting the output features of the sounds to be listened in an audio system in which the features of the sounds to be listened would otherwise vary according to where the attaching position is.

According to an embodiment of the present disclosure, there is provided a signal processing device including a first reproduced sound outputting section configured to cause a first reproduced sound providing section to provide a first reproduced sound, a second reproduced sound outputting section configured to cause a second reproduced sound providing section to provide a second reproduced sound, a comparison result obtaining section configured to obtain a result of comparison between the first reproduced sound and the second reproduced sound, and a correcting section configured to generate, based on the obtained result of comparison, a signal for correcting an output feature of the second reproduced sound from the second reproduced sound outputting section.

According to another embodiment of the present disclosure, there is provided a signal processing method including causing a first reproduced sound providing section to provide a first reproduced sound, causing a second reproduced sound providing section to provide a second reproduced sound, obtaining a result of comparison between the first reproduced sound and the second reproduced sound, and generating, based on the obtained result of comparison, a signal for correcting an output feature of the second reproduced sound.

According to another embodiment of the present disclosure, there is provided a computer program for causing a computer to perform causing a first reproduced sound providing section to provide a first reproduced sound, causing a second reproduced sound providing section to provide a second reproduced sound, obtaining a result of comparison between the first reproduced sound and the second reproduced sound, and generating, based on the obtained result of comparison, a signal for correcting an output feature of the second reproduced sound.

As explained above, according to one or more embodiments of the present disclosure, there are provided a signal processing device, a signal processing method, and a computer program, each of which makes it possible to listen suitable sounds regardless of where the attaching position is, by appropriately correcting the output features of the sounds to be listened in an audio system in which the features of the sounds to be listened would otherwise vary according to where the attaching position is.

Note that the effects described above are not necessarily limited, and along with or instead of the effects, any effect that is desired to be introduced in the present specification or other effects that can be expected from the present specification may be exhibited.

DETAILED DESCRIPTION OF THE EMBODIMENT(S)

Figure 1:
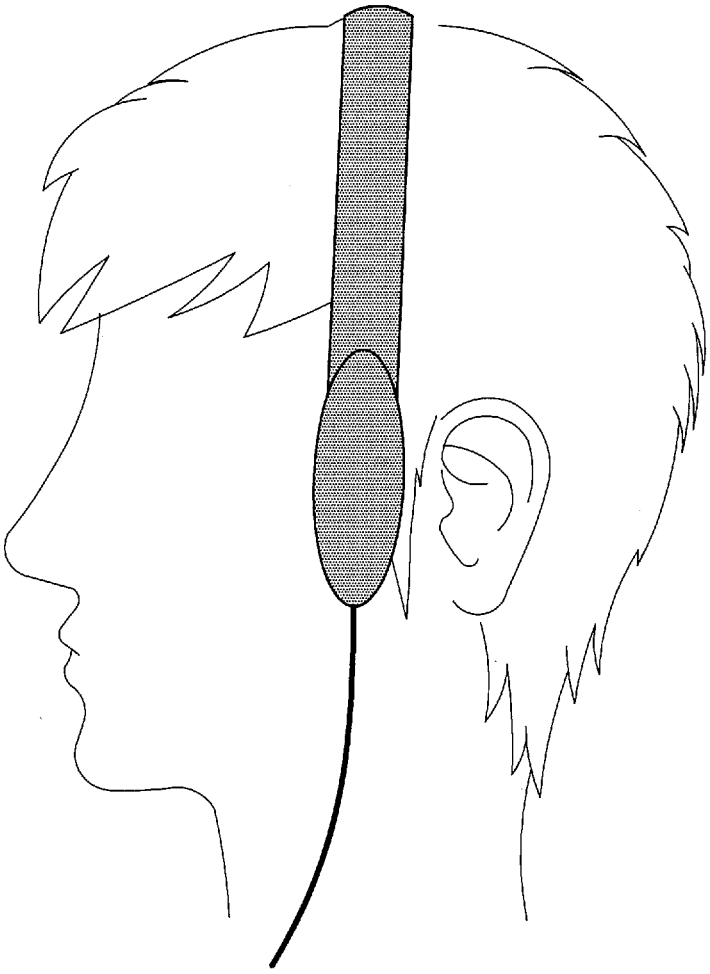
FIG. 1 is an explanatory view illustrating one example of an attaching position of a bone conduction headphone.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The explanation herein will proceed in the following order.

1. One embodiment of the present disclosure.
1.1. Overview of bone conduction speaker
1.2. Exemplary functional configuration
1.3. Exemplary operation
1.4. Modifications
2. Conclusion

1. One Embodiment of the Present Disclosure

[1.1. Overview of Bone Conduction Speaker]

Before explaining one exemplary functional configuration of a signal processing device according to one embodiment of the present disclosure, an overview of a bone conduction speaker for listening bone conduction sounds is explained here. Bone conduction speakers are configured for listening bone conductions sounds transmitted via vibration of bones, especially skull bone, unlike a speaker for listening sounds via a drum membrane. For the bone conduction speakers, attaching positions to which a vibration section of the bone conduction speakers is attached is not always a particular fixed position, unlike speakers (aerial conduction speakers) for listening sounds via aerial conduction by attaching the speaker to auricle or acoustic duct.

Figure 2:
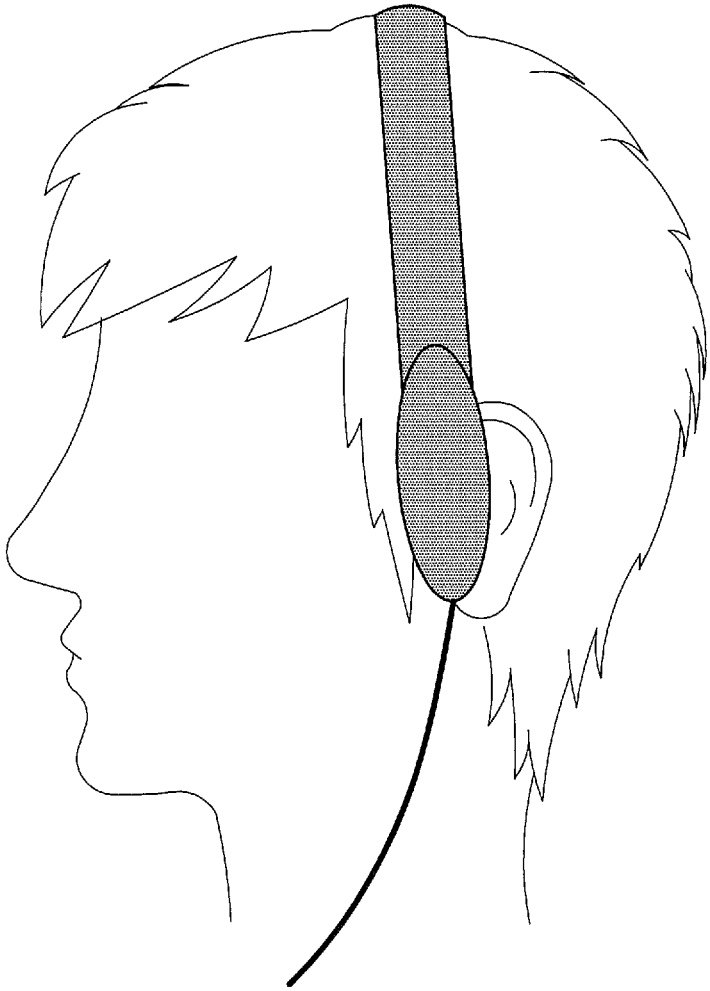
FIG. 2 is an explanatory view illustrating one example of an attaching position of a bone conduction headphone.

In using the bone conduction speaker, it is not always a case that sounds in high sound range sound strong for a user of the bone conduction speaker when a vibration section of the bone conduction speaker is attached to user's temple. In such cases, the sounds in high sound range would sound strong for the user when the vibration section is attached to a place other than the temple. For example, some users would attach the vibration section to the vicinity of their temples as illustrated in FIG. 1 in order to listen to the bone conduction sounds, while the other some users would attach the vibration section to the vicinity of their tragus as illustrated in FIG. 2 in order to listen to the bone conduction sounds.

Such difference in attaching positions of the bone conduction speaker would lead to difference in the features of output sounds over an entire sound range. For example, when there is a remarkable difference in the feature of the output sounds in a high sound range, the feature of the sounds the user listen to would be different from the genuine features the outputs sounds are supposed to have. Because each user attaches the bone conduction speaker to a place as desired by the user, it is difficult for the user to notice that the sound the user is listening to is not sounds with genuine features, even though the sounds the user is listening to via the place are not sounds having the genuine features the sounds are supposed to have.

Furthermore, in many cases, the sounds that the listener listens to are not only the bone conduction sounds, but also aerial conduction sounds leaked from the vibration section and transmitted via aerial conduction. The output features of the bone conduction speakers have been measured by, for example, measuring levels of vibration forces of the vibration section. However, because the difference in the attaching positions of the bone conduction speaker as described above results in difference in the features of the sounds being listened, it is desirable that desirable frequency features on which the features of the output sounds of the bone conduction speaker are corrected so that human being will listen to the output sounds with the desirable frequency features are a mixture of these sensed via bone conduction and aerial conduction as actually sensed by human.

It is known that sensitivity to listen the bone conduction sounds are greatly varies among users, and that it is possible to compare the aerial conduction sounds and the bone conduction sounds in terms of loudness even though the aerial conduction sounds and the bone conduction sounds are different in their transmission routes (Watanabe et. al. "Study on acoustic signal transmission via bone conduction in consideration of loudness correction" Research Report of Research Center for Advances Technologies/High-tech Research Center (2006) pp. 97-100). Therefore, one embodiment of the present disclosure describes a signal processing device, which compares a standard sound (sound listened via aerial conduction sound) with a sound listened via bone conduction, and conducts correction of a feature of the sound listened via bone conduction, whereby sounds listened not only via aerial conduction sounds but also via the other conduction can be appropriately listened by a user using a bone conduction speaker whose features would otherwise vary according to where an attaching position of the bone conduction speaker is.

[1.2. Exemplary Functional Configuration]

Figure 3:
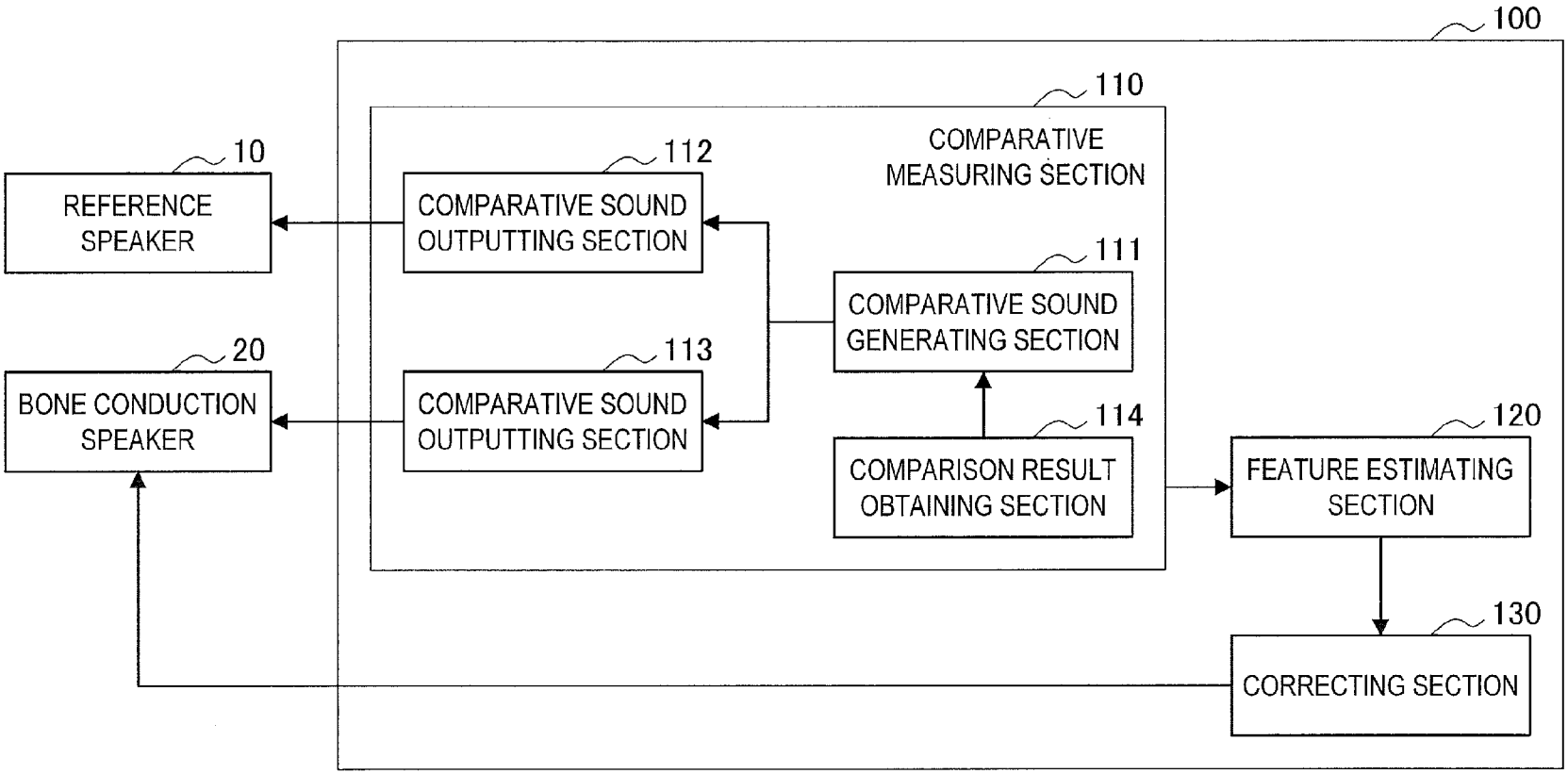
FIG. 3 is an explanatory view illustrating one exemplary functional configuration of a signal processing device 100 according to one embodiment of the present disclosure.

FIG. 3 is an explanatory view illustrating an exemplary functional configuration of a signal processing device 100 according to one embodiment of the present disclosure.

The signal processing device 100 according to one embodiment of the present disclosure as illustrated in FIG. 3 is a device configured to correct a feature of a sound to be outputted from a bone conduction speaker 20 configured to cause a user, who is a listener, to listen the sound via bone conduction. The signal processing device 100 according to one embodiment of the present embodiment is configured to output a signal either of a reference speaker 10 and a bone conduction speaker 20 alternatively and sequentially in such a way that the signal processing device 100 switches over whether to output the signal to the reference speaker 10 or to the bone conduction speaker 20, so that the reference speaker 10 or the bone conduction speaker 20 is caused to output a predetermined reference sound sequentially. The reference speaker 10 is a speaker for outputting a sound serving as a comparative reference with respect to a sound outputted from the bone conduction speaker 20. The reference speaker 10 may be, for example, a speaker for outputting a reproduced sound not including a bone conduction sound, and may be a general speaker for transmitting an aerial conduction sound to the listener. The signal processing device 100 may be connected with the reference speaker 10 and the bone conduction speaker 20 via wireless connection or wireless connection.

The user listens to the output sound from the reference speaker 10 and the output sound from the bone conduction speaker 20. The user compares the output sounds with each other and provides a result of the comparison to the signal processing device 100. Based on the result of the comparison thus provided by the user, the signal processing device 100 corrects output sounds of the bone conduction speaker 20 in such a way that the output sounds from the bone conduction speaker 20 will sound equivalently to the output sounds of the reference speaker 10.

By performing the correction of the output sounds of the bone conduction speaker 20, the signal processing device 100 according to one embodiment of the present disclosure makes it possible that, regardless of where the attaching position preferred by the user to attach the bone conduction speaker 20 in order to listen the sounds from the bone conduction speaker 20 is, the output sounds from the bone conduction speaker 20 can be sounds with features substantially equivalent to genuine features the output sounds are supposed to have. In the following, a functional configuration of the signal processing device 100 according to one embodiment of the present disclosure is explained in detail.

As illustrated in FIG. 3, the signal processing device 100 according to one embodiment of the present disclosure includes a comparative measuring section 110, a feature estimating section 120, and a correcting section 130.

The comparative measuring section 110 is configured to provide an audio signal of a comparative sound to the reference speaker 10 and the bone conduction speaker 20, and to obtain a result of listening the comparative sound from the reference speaker 10 and the comparative sound from the bone conduction speaker 20 in order to compare which one of the comparative sounds is louder for the user listening to the comparative sounds. That is, the comparative measuring section 110 causes the user to compare which one of the sound (for example, aerial conduction sound) from the reference speaker 10 and the sound (bone conduction sound) from the bone conduction speaker 20 is louder when the user listens to the sounds. In this embodiment, the signal sent from the comparative measuring section 110 to the reference speaker 10 is such a signal that causes the reference speaker 10 to output a sound whose standard is based on such a case that the sound outputted from the reference speaker 10 is listened under certain listening conditions. The certain listening conditions are not limited to particular ones. For example, the certain listening conditions may be such that the reference speaker 10 is placed at a position located at a distance of approximately 1 meter from a listener right in front of the reference speaker 10.

As illustrated in FIG. 3, the comparative measuring section 110 includes a comparative sound generating section 111, comparative sound outputting sections 112 and 113, and a comparison result obtaining section 114.

The comparative sound generating section 111 is configured to generate the audio signal for the comparative sound, which audio signal is to be supplied to the reference speaker 10 and the bone conduction speaker 20. The comparative sound generating section 111 is, for example, configured to generate the comparative sound as sign wave sounds or noise sounds generated by use of an octave filter so that the sign wave sounds or noise sounds have a plurality of predetermined center frequencies, respectively. The comparative sound generating section 111 supplies to the comparative sound outputting sections 112 and 113 the audio signal thus generated.

The comparative sound outputting sections 112 and 113 are configured to supply the audio signal of the comparative sound to the reference speaker 10 and the bone conduction speaker 20, respectively. The comparative sound outputting sections 112 and 113 perform the supply of the audio signal of the comparative sound by alternatively outputting the audio signal. By the alternative output of the audio signal of the comparative sound by the comparative sound outputting sections 112 and 113, it is possible to easily cause the user to compare the sound (for example, aerial conduction sound) from the reference speaker 10 and the sound (bone conduction sound) from the bone conduction speaker 20 as to which one of sounds is louder for the user listening to the sounds.

For example, the comparative sound outputting sections 112 and 113 perform the alternative output of the audio signal of the comparative sounds by respectively outputting the audio signal once alternatively, or by respectively outputting the audio signal twice alternatively, or by outputting the audio signal once from one of the comparative sound outputting sections 112 and 113 and outputting the audio signal once from the other one of the comparative sound outputting sections 112 and 113 before and after the one of the comparative sound outputting sections 112 and 113 performs the output of the audio signal (that is, the audio signal is outputted three times in total, for example, in the order of the comparative sound outputting sections 112, 113, and 112), or the other pattern. Each output of the audio signal is continued for a certain period of time (for example, in a range of 0.5 seconds to 1 second).

In the other words, the comparative measuring section 110 is capable of making it possible for the user to alternatively listen to the comparative sound outputted from the reference speaker 10 and the comparative sound outputted from the bone conduction speaker 20. By alternatively listening to the comparative sound outputted from the reference speaker 10 and the comparative sound outputted from the bone conduction speaker 20, the user can judge which one of the comparative sounds is greater or smaller in acoustic pressure (loudness of sound). The output of the audio signal from the comparative sound outputting sections 112 and 113 may be carried out by switching over the output in such a way that the user hears the comparative sounds outputted continuously completely, or hears the comparative sounds with a silent interval during switching-over of the comparative sounds.

The comparison result obtaining section 114 is configured to obtain a result of the comparison performed by the user between the comparative sound outputted from the reference speaker 10 and the comparative sound outputted from the bone conduction speaker 20, which result of the comparison indicates which one of the comparison sounds outputted from the reference speaker 10 and the bone conduction speaker 20 is louder, or whether the comparative sounds from both of the reference speaker 10 and the bone conduction speaker 20 sound equivalently to each other.

How to cause the user to provide the result of comparison is not limited to a particular example, and may be performed by using any structure or method that can input the result of the comparison to the comparison result obtaining section 114. For example, the input may be performed by providing buttons connected with the signal processing device 100, and causing the user to press one of the bottoms, which is associated with that one of the reference speaker 10 and the bone conduction speaker 20, whose comparative sound is louder than the other. As a result of such input, the comparison result obtaining section 114 receives the result of the comparison. Moreover, the signal processing device 100 may be provided with one button for inputting such a result of the comparison that the sounds from both of the reference speaker 10 and the bone conduction speaker 20 sound equivalently to each other, so that when the user considers that the sounds sound equivalently to each other, the user inputs the result of the comparison by pressing this button.

After the comparison result obtaining section 114 obtains the result of the comparison performed by the user on the comparative sounds, the comparison result obtaining section 114 sends information of the result of the comparison to the comparative sound generating section 111. After the comparative sound generating section 111 receives the result of the comparison, the comparative sound generating section 111 adjusts an acoustic pressure of one of the reference speaker 10 and the bone conduction speaker 20 on the basis of the result of the comparison, and again causes comparative sounds, one of which has been thus adjusted, to be outputted. For example, if the user judges that the comparative sound outputted from the reference speaker 10 is louder, the comparative sound generating section 111 would adjust the acoustic pressure of the comparative sound outputted from the bone conduction speaker 20.

The comparative sound generating section 111 may be configured to perform the adjustment of the acoustic pressure in such a way that the acoustic pressure is adjusted on a predetermined unit basis, such as 1 dB, and 2 dB, for example. The comparative sound generating section 111 regenerates the sound signals, to be supplied to the reference speaker 10 and the bone conduction speaker 20, of the comparative sounds in such a way that the acoustic pressure from one of the reference speaker 10 and the bone conduction speaker 20 will be adjusted. The comparative sound generating section 111 repeats the output of the comparative sounds and the adjustment of the acoustic pressure until the user judges as a result of the comparison that the comparative sounds are equivalent to each other at the certain frequency.

For each comparative sound (of different center frequencies) outputted from the comparative measuring section 110, the comparative measuring section 110 notifies the feature estimating section 120 of how much the comparative sound generating section 111 adjusted the acoustic pressure of this comparative sound.

The comparative measuring section 110 generates the comparative sounds having different center frequencies, so that the user will perform the comparison on comparative sounds with such difference center frequencies. The comparative measuring section 110 may set the center frequencies to any frequencies. For example, comparative sounds whose center frequencies are 500 Hz, 1000 Hz, 2000 Hz, and 4000 Hz, may be generated for the comparison performed by the user.

Moreover, for example, the comparative measuring section 110 may select the center frequencies from among frequencies of sounds that an audiometer generates for use in pure-tone audiometry. The audiometer can generate sounds of 125 Hz, 250 Hz, 500 Hz, 750 Hz, 1000 Hz, 1500 Hz, 2000 Hz, 3000 Hz, 4000 Hz, 6000 Hz, and 8000 Hz. General aerial conduction audiometry is carried out with frequencies of 125 Hz, 250 Hz, 500 Hz, 1000 Hz, 2000 Hz, 4000 Hz, and 8000 Hz. The comparative measuring section 110 may generate comparative sounds with center frequencies of 500 Hz, 1000 Hz, 2000 Hz, and 4000 Hz from among these frequencies, for the comparison performed by the user.

By selecting those frequencies as the center frequencies, the comparative measuring section 110 can measure features in a high sound range, a mid sound range, and a low sound range that the bone conduction speaker 20 has in the state of being worn by the user at the time of measuring the comparison sounds as to whether the acoustic pressures of the comparative sounds are large or small.

The feature estimating section 120 is configured to estimate, on the basis of the result of the comparison at each center frequency, the features of the bone conduction speaker 20 in the state of being worn by the user at the time of measuring the comparative sounds as to whether the acoustic pressures of the comparative sounds are large or small, the result of the comparison having been outputted from the comparative measuring section 110. The feature estimating section 120 can plot the result of the comparison of each center frequency in order to perform the estimation of the features of the bone conduction speaker 20 in the state of being worn by the user at the time of measuring the comparative sounds as to whether the acoustic pressures of the comparative sounds are large or small. The feature estimating section 120 outputs, to the correcting section 130, information on the estimated features of the bone conduction speaker 20 in the state of being worn by the user at the time of measuring the comparative sounds.

The correcting section 130 is configured such that, based on the information on the estimated features of the bone conduction speaker 20 in the state of being worn by the user at the time of measuring the comparative sounds as to whether the acoustic pressures of the comparative sounds are large or small, the correcting section 130 corrects an audio signal to be sent to the bone conduction speaker 20. As an alternative, the correcting section 130 may be configured to correct, based on information on the feature of the reference speaker 10, the audio signal to be sent to the bone conduction speaker 20. The correcting section 130 may be configured to perform the correction process by, for example, passing the audio signal through an equalizing circuit for giving a frequency feature opposite to the feature of the bone conduction speaker 20 in the state of being worn by the user at the time of measuring. By passing the audio signal through such an equalizing circuit, the correcting section 130 can compensate for a frequency range for which the output of the bone conduction speaker 20 being listened was excess or deficient. In this way, the correcting section 130 can solve the excess or deficit of the output of the bone conduction speaker 20.

In case where desirable features of the bone conduction speaker 20 has been known in advance, the correcting section 130 may be configured to increase or decrease sounds of a frequency range at which the acoustic pressure is different from the feature of the output of the feature estimating section 120 by a predetermined degree or more, so that the correcting section 130 will correct the features to be desirable for the user listening to the bone conduction speaker 20. For example, when the features outputted from the feature estimating section 120 sound such that the high sound range is significantly deficient, the correcting section 130 performs such correction process that the output is reinforced in the high sound range in consideration of the features.

For example, the correcting section 130 may perform such correction process that a frequency feature of the inverse phase of the frequency feature estimated by the feature estimating section 120 is prepared, and the prepared frequency feature of the inverse phase is superimposed on the audio signal. Moreover, the correcting section 130 may perform such correction process that desirable frequency features for the bone conduction speaker 20 are stored in advance and an equivalent coefficient to which a desirable frequency feature has been given is created after the frequency feature of the inverse phase of the frequency feature estimated by the feature estimating section 120 is superimposed to the audio signal.

By performing such correction that, based on the information on the feature of the bone conduction speaker 20 in the state of being worn by the user at the time of measuring whether the acoustic pressures of the comparative sounds are large or small, the correcting section 130 corrects the audio signal to be sent to the bone conduction speaker 20, the correcting section 130 can cause the user to listen to reproduced sounds whose genuine frequency features the reproduced sounds are supposed to have are ensured in terms of a frequency range in which the reproduced sounds would not have the genuine frequency features otherwise. Therefore, the signal processing device according to the embodiment of the present disclosure can perform a signal processing process for causing a user of the bone conduction speaker 20 to hear from the bone conduction speaker 20 such reproduced sounds that have the genuine frequency features.

The configuration of the signal processing device 100 according to one embodiment of the present disclosure as illustrated in FIG. 3 may be provided to devices such as a music reproducing device for reproducing music, an image processing deice for reproducing an image, an audio outputting device for outputting an audio data to the bone conduction speaker 20, and a mobile phone. By being provided with the configuration of the signal processing device 100 according to one embodiment of the present disclosure as illustrated in FIG. 3, the devices can perform such signal processing to cause a user to hear from the bone conduction speaker 20 such reproduced sounds having genuine frequency features the reproduced sounds are supposed to have.

Described above referring to FIG. 3 is one exemplary functional configuration of a signal processing device 100 according to one embodiment of the present disclosure. The configuration of the signal processing device 100 according to one embodiment of the present disclosure as illustrated in FIG. 3 may be mounted in a processing section capable of performing signal processing, such as an internal memory of DSP (Digital Signal Processor) included in an apparatus for reproduction based on audio data or music data, or an external memory provided as a peripheral to such a DSP. Next, an exemplary operation of such a signal processing device 100 according to one embodiment of the present disclosure is explained below.

[1.3. Exemplary Operation]

Figure 4:
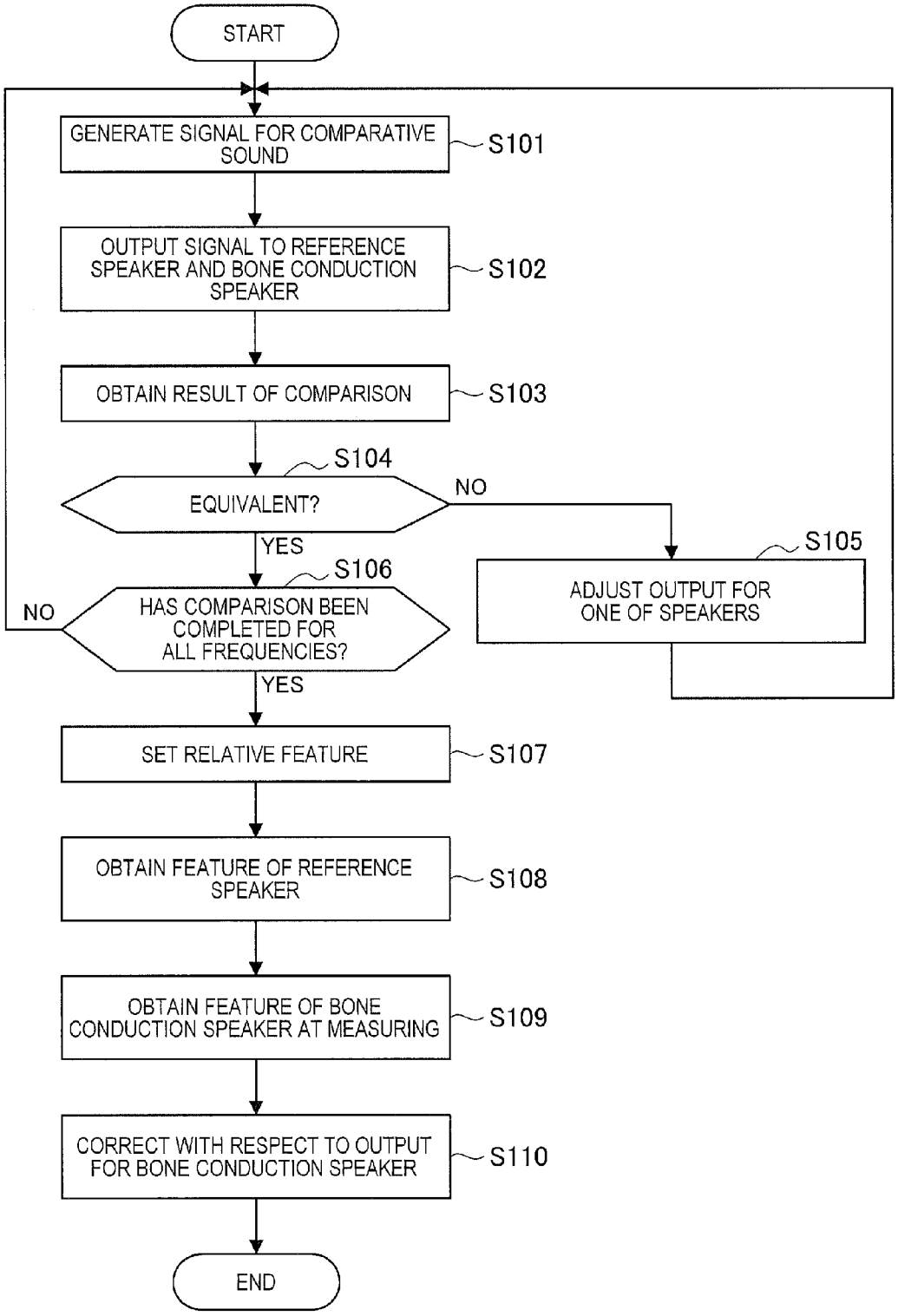
FIG. 4 is a flow chart illustrating one exemplary operation of the signal processing device 100 according to one embodiment of the present disclosure.

FIG. 4 is a flow chart illustrating one exemplary operation of a signal processing device 100 according to one embodiment of the present disclosure. The flow chart illustrated in FIG. 4 illustrates one exemplary operation, which the signal processing device 100 performs in order to carry out such signal processing for causing a user of the bone conduction speaker 20 to listen to reproduced sounds with genuine frequency features the reproduced sounds supposed to have. In the following, the exemplary operation of the signal processing device 100 according to one embodiment of the present disclosure is described referring to FIG. 4.

In order to allow a user of the bone conduction speaker 20 to listen to reproduced sounds with such genuine frequency features, the signal processing device according to one embodiment of the present disclosure generates audio signals of comparative sounds (Step S101), which audio signals are to be supplied to the reference speaker 10 and the bone conduction speaker 20, respectively. The process at Step S101 may be carried out by the above-described comparative sound generating section 111, for example. The audio signals of the comparative sounds may be generated for a plurality of center frequencies, but the explanation herein explains that audio signals of comparative sounds with one center frequency is generated.

After generating the audio signals of the comparative sounds at the Step S101, the signal processing device 100 supplies the audio signals of comparative sounds thus generated to the reference speaker 10 and the bone conduction speaker 20, respectively (Step S102). The process at Step S102 may be carried out by the comparative sound outputting sections 112 and 113, for example.

As described above, the comparative sound outputting sections 112 and 113 output the audio signals of the comparative sounds alternatively. For example, the comparative sound outputting sections 112 and 113 outputs the audio signals of the comparative sounds alternatively twice each for a predetermined period of time. For example, Step S102 may be carried out in such a way that the user can alternatively listen to the comparative sound outputted from the reference speaker 10 and the comparative sound outputted from the bone conduction speaker 20. The outputs of the audio signals at Step S102 may be switched over in such a way that the comparative sounds sound completely continuously or may be switched over with a silent interval between the outputs.

After supplying the audio signals of the comparative sounds to the reference speaker 10 and the bone conduction speaker 20 at Step S102, the signal processing device 100 obtains a result of comparison on the comparative sounds by the user (Step S103). The process at Step S103 may be carried out by the comparison result obtaining section 114, for example.

At Step S103, the signal processing device 100 is notified of, as the result of the comparison result, which one of the reference speaker 10 and the bone conduction speaker 20 sounds louder, or is notified whether the comparative sounds from both of the reference speaker 10 and the bone conduction speaker 20 sound equivalently to each other. How the user provides the result of the comparison is not limited to a particular example. The input of the result of the compassion may be performed by, for example, providing the signal processing device 100 with buttons, so that the user presses one of the button which is associated with a louder one of the reference speaker 10 and the bone conduction speaker 20. Moreover, the signal processing device 100 may be provided with a button to be pressed when the sounds from both of the reference speaker 10 and the bone conduction speaker 20 sound equivalently to each other.

After obtaining the result of the comparison performed by the user at Step S103, the signal processing step 100 judges whether or not the user felt that the comparative sound outputted from the reference speaker 10 and the comparative sound outputted from the bone conduction speaker 20 are equivalent to each other in loudness (Step S104). The process at Step S104 may be carried out by the comparative sound generating section 111 or the comparison result obtaining section 114.

If the judgment at Step S104 judges that the user did not feel that the comparative sounds from both of the reference speaker 10 and the bone conduction speaker 20 are equivalent to each other in loudness, (No at Step S104), then the signal processing device 100 changes a sound pressure of one of the reference speaker 10 and the bone conduction speaker 20 (Step S105), and regenerates the audio signals of the comparative sounds with the adjusted sound pressure. For example, if the user judges that the sound from the bone conduction speaker 20 sounds smaller, the signal processing device 100 performs such signal processing that increases the sound pressure of the sound from the comparative sound outputting section 113, or decreases the sound pressure of the sound from the comparative sound outputting section 112.

The signal processing device 100 may perform the sound pressure adjustment at Step S105 by adjusting the sound pressure on a unit basis such as 1 dB, and 2 dB. The sound pressure adjustment may adjust any one of the reference speaker 10 and the bone conduction speaker 20. However, in case where the sounds become too small in loudness, it would be difficult for the user to judge which one of the sounds is louder. Therefore, the signal processing device 100 may be configured such that a predetermined threshold is provided to restrict that the sound pressure adjustment is performed in such a way that the sound pressure will not be lowered below the threshold.

If the judgment at Step S104 judges that the user felt that the comparative sounds from both of the reference speaker 10 and the bone conduction speaker 20 sound equivalently to each other in loudness (Yes at Step S104), then the signal processing device 100 judges whether or not the comparison for all of the center frequencies for the comparison has been completed (Step S106). The process at Step S106 may be carried out by the comparative sound generating section 111, for example.

If the judgment at Step S106 judges that the comparison for all of the center frequencies for comparison has not been completed yet (No at Step S106), the signal processing device 100 again generates the audio signals of the comparative sounds at a center frequency for which the comparison has not been carried out yet. If the judgment at Step S106 judges that the comparison for all of the center frequencies for the comparison has been already completed (Yes at Step S106), then the signal processing device 100 sets a relative feature of the bone conduction speaker 20 with reference to the reference speaker 10 (Step S107). The process at Step S107 may be carried out by the comparative sound generating section 111, for example. The relative feature of the bone conduction speaker 20 can be worked out by gathering the acoustic pressures adjusted with respect to the comparative sounds for the respective center frequencies for the comparison.

The signal processing device 100 according to one embodiment of the present disclosure can set the center frequencies to any frequencies, but may be configured to generate the comparative sounds with center frequencies set to, for example, 500 Hz, 1000 Hz, 2000 Hz, and 4000 Hz, as described above, so as to cause the user to compare the comparative sounds at these center frequencies. As an alternative, the signal processing device according to one embodiment of the present disclosure may be configured to select the center frequencies from among the frequencies of sounds that an audiometer generates for use in pure-tone audiometry, for example.

The signal processing device 100 according to one embodiment of the present disclosure may be configured to set the central frequencies to frequencies with intervals of less than one octave, for example, ⅓ octave. If the intervals between the central frequencies are ⅓ octave, and if the comparison of the comparative sounds is carried out in a range of 25 Hz to 20000 Hz, the signal processing device 100 according to one embodiment of the present disclosure may perform the comparison at thirty (30) central frequencies of 25 Hz, 31.5 Hz, 40 Hz, 50 Hz, 63 Hz, 80 Hz, 100 Hz, 125 Hz, 160 Hz, 200 Hz, 250 Hz, 315 Hz, 400 Hz, 500 Hz, 630 Hz, 800 Hz, 1000 Hz, 1250 Hz, 1600 Hz, 2000 Hz, 2500 Hz, 3150 Hz, 4000 Hz, 5000 Hz, 6300 Hz, 8000 Hz, 10000 Hz, 12500 Hz, 16000 Hz, and 20000 Hz.

Human acoustic sense is such that a mixture of components in a narrow range of frequencies is sensed as one sound. It is known that the range of frequencies becomes wider proportionally as the frequencies become higher. When analysis is carried out on the basis of octave-interval components by converting the frequencies logarithmically, it is possible to obtain signal analysis result approximate to the process in acoustic system. Such octave analysis is often employed for evaluation of noises, which closely relate to loudness of sounds. For the octave analysis, ⅓ octave analysis or 1/1 octave analysis are often employed in consideration of human critical band width.

The signal processing device 100 according to one embodiment of the present disclosure performs the comparison by adjusting the frequencies so finely, thereby being capable of appropriately performing finer correction process, for example, in consideration of differences in user's individual features. As a result of the signal process performed by the signal processing device 100, the user can listen to music by use of the bone conduction speaker 20 with desired features.

After setting the relative feature of the bone conduction speaker 20 at the Step S107, the signal processing device 100 obtains the feature of the reference speaker 10 (Step S108). The process at Step S108 may be carried out by the feature estimating section 120, for example. In order to perform the obtaining process at Step S108, the signal processing device 100 may be configured to store features of the reference speakers in advance, may be configured to actually measure a frequency feature of the reference speaker 10, or may be configured to obtain, as the feature of the reference speaker 10, a frequency feature typical to speakers.

After obtaining the feature of the reference speaker 10 at Step S108, the signal processing device 100 obtains a feature of the bone conduction speaker being worn by the user at the time of measuring the comparative sounds (Step S109). The process at Step S109 may be performed by the feature estimating section 120, for example. At Step S109, the signal processing device 100 estimates the feature of the bone conduction speaker 20 in the state of being worn by the user at the time of measuring, the signal processing device 100 performing the estimation of the feature of the bone conduction speaker 20 on the basis of the relative feature of the bone conduction speaker 20 being set at Step S107 on the basis of the comparison result for each of the center frequencies. By plotting the result of the comparison for each of the center frequencies, the signal processing device 100 can estimate the feature of the bone conduction speaker 20 in the state of being worn by the user at the time of measuring.

After obtaining the feature of the bone conduction speaker 20 in the state of being worn by the user at the time of measuring the comparative sounds at Step S109, the signal processing device 100 carries out correction process of signals to be outputted to the bone conduction speaker 20, the signal processing device 100 performing the correction process on the basis of the feature, obtained at Step S108, of the reference speaker 10 and the feature, obtained at Step S109, of the bone conduction speaker 20 in the state of being worn by the user at the time of measuring the comparative sounds (Step S110). The process at Step S110 may be carried out by the correcting section 130, for example.

In case where a desirable feature of the bone conduction speaker 20 has been known in advance, the signal processing device 100 increases or decreases sounds in a frequency range in which acoustic pressures are different from the feature of the reference speaker 10 by a certain degree or more, thereby correcting the feature of the bone conduction speaker 20 to the desirable feature to be listened by the user. For example, in case where an ideal state of wearing the bone conduction speaker 20 is such a state that the bone conduction speaker 20 is so worn as to allow a greatest output in the high sound range, but the feature outputted at Step S109 sounds such that the components in the high sound range are significantly deficient, the signal processing device 100 performs such correction that reinforces the components in the high sounds range at Step S110.

As an alternative, for example, the signal processing device 100 may be configured to perform such a correction process at Step S110 that a frequency feature of the inverse phase of the frequency feature outputted at Step S109 is generated and the frequency feature of the inverse phase is superimposed on the audio signal. As an alternative, the signal processing device 100 may be configured to perform such a correction process at Step S110 that desirable frequency features of the bone conduction speaker 20 are stored in advance, and an equivalent coefficient based on a frequency feature selected from among the desirable frequency features is created after the frequency feature of the inverse phase of the frequency feature estimated at Step S109 is superimposed to the audio signal.

A signal processing device 100 according to one embodiment of the present disclosure performs the above-described series of operations in order to perform such correction that the audio signal to be sent to the bone conduction speaker 20 is corrected based on the information on the feature of the bone conduction speaker 20 in the state of being worn by a user at the time of measuring the comparative sounds. By performing such correction, the signal processing device 100 makes it possible that the user can listen to reproduced sounds having genuine frequency features the reproduced sounds are supposed have in a frequency range in which the reproduced sounds that the user is listening to would not have such genuine frequency features otherwise. Therefore, by performing the series of operations described above, the signal processing device 100 according to one embodiment of the present disclosure is capable of performing such signal processing that the user using the bone conduction speaker 20 can listen to reproduced sounds having genuine frequency features that the reproduced sounds are supposed to have.

As described above, frequency features of bone conduction speakers would entirely vary according to attaching position of the bone conduction speakers in some cases. Thus, a signal processing device 100 according to one embodiment of the present disclosure may be configured such that frequencies features of a bone conduction speaker at typical attaching positions (such as the vicinity of temple, the vicinity of tragus) are stored in advance, so that the user selects one frequency feature from among the frequency features when the user uses the bone conduction speaker. With this configuration, the signal processing device 100 is capable of making it possible for the user to listen to appropriate reproduced sounds even if the user changes the attaching position.

More specifically, the signal processing device 100 obtains a frequency feature that the bone conduction speaker has when the attaching position of the bone conduction speaker is at a positon of temple, and notifies the correcting section 130 of the frequency feature of the inverse phase of this frequency feature. After that, the signal processing device 100 obtains a frequency feature of the bone conduction speaker after being moved to an attaching position which the user finds that sounds in the high sound range are most appropriate when the bone conduction speaker is at this attaching position. The signal processing device 100 notifies the correcting section 130 of the frequency feature of the inverse phase of this frequency feature. The reason why such an attaching positon is selected as the typical attaching position is that these attaching positions are considered as a position at which a user normally attaches the bone conduction speaker, and a positon at which a user easily feels that the sounds are hi-fi when the user listens to music (feeling hi-fi is an indicator that a user can easily determine). Another reason is that frequency features of a bone conduction speaker greatly vary depending on the attaching position even if the same user is wearing the bone conduction speaker.

As an alternative, a signal processing device 100 may be configured such that a plurality of frequency features of the bone conduction speaker is stored in advance, so that comparative trial listening can be performed with a frequency feature selected by switching over the plurality of frequency features according to an attaching position at which the user wants to attach the bone conduction speaker, in order to allow the user to select the frequency feature of the bone conduction speaker arbitrarily. The frequency features of the bone conduction speaker has various causes of variations such as where is the attaching position, how much is an attaching force, and how much is an attaching degree. Therefore, by configuring the signal processing device such that the user can arbitrarily select the frequency feature of the bone conduction speaker, it is possible to allow the user to appropriately hear reproduced sounds from the bone conduction speaker even if the user changes the attaching position and attaching condition of the bone conduction speaker.

In case of output of comparative sounds from a bone conduction speaker 20 such as a headphone-type speaker including a vibrating section for each of right and left sides of a head, the signal processing device 100 may be configured to perform such switching-over of comparative sounds that, for example, the signal processing device 100 causes the bone conduction speaker 20 to output a comparative sound only from a right ear side after the signal processing device 100 causes the reference speaker 10 to output a comparative sound, and then the signal processing device 100 causes the bone conduction speaker 20 to output a comparative sound only from a left ear side after the signal processing device 100 causes the reference speaker 10 to output a comparative sound again.

[1.4. Modifications]

The above explanation has described exemplary operations of the signal processing device 100 by which, even if the attaching position or attaching condition of the bone conduction speaker worn by a user is changed, appropriate listening of reproduced sounds from the bone conduction speaker can be ensured for the user by correcting the frequency feature differences due to the differences in the attaching positions of the bone conduction speaker. However, speakers whose frequency features would vary depending on their attaching position or attaching condition are not limited to bone conduction speakers.

For example, a canal type earphone would vary in frequency feature depending on its attaching position or attaching condition. Some canal type earphones are designed to seal an auditory canal in order to attain a desired feature. However, every human being is different from each other in terms of auditory canals individually, and therefore it is not always easy for a user to judge whether or not appropriate sealing is achieved by a current attaching condition. The issue of sealing is currently dealt with by absorbing the individual differences in auditory canals by providing ear chips having various sizes and shapes as accessories.

However, there would be uses with some sizes and shapes of acoustic ducts, which will not allow appropriate sealing. In such a case, it is difficult to use the speaker with a desired feature. Furthermore, users have different preferences as to how to wear the speaker comfortably for the use. Therefore, some users would not like completely-sealed attachment. Moreover, it is disadvantageous in cost to provide plural kinds of ear chips. When the ear duct and the ear chip do not fit well, this would affect acoustic quality, and for example would result in sounds with significant defects in low sound range, thereby not allowing the user to enjoy comfortably listening to music or the like with the canal type earphone.

Figure 5:
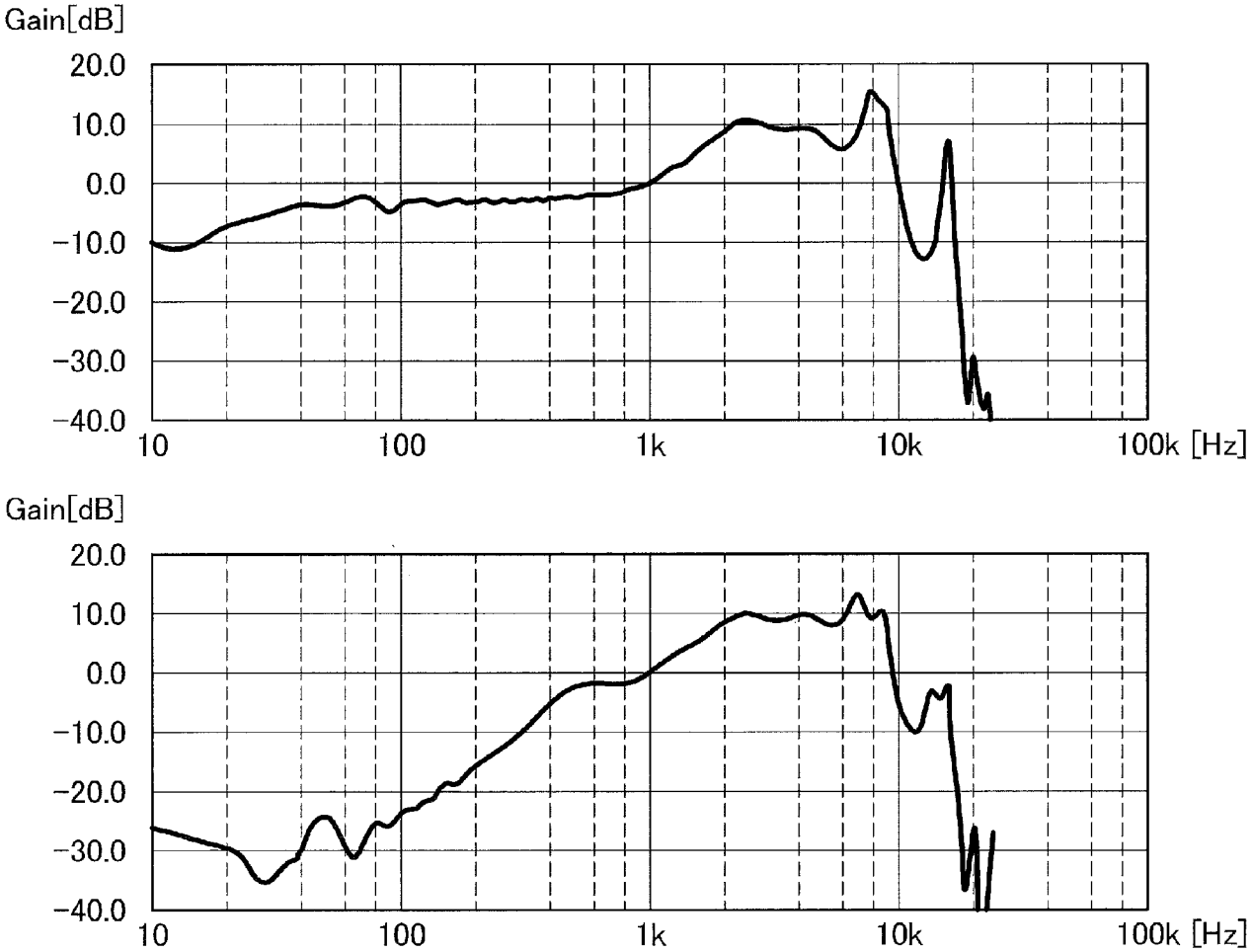
FIG. 5 is an explanatory view illustrating one example of different frequency features due to differences in attaching conditions of an earbud of canal type.

FIG. 5 is an explanatory view illustrating an example of frequency feature differences caused due to differences in attaching conditions of a canal-type earphone. The graph in the upper part of FIG. 5 illustrates an example of a frequency feature as designed. The graph in the lower part of FIG. 5 illustrates an example of a frequency feature attained in case where an ear duct is incompletely sealed by the earphone. It can be understood that when an ear duct is incompletely sealed by the earphone as such, especially the feature in the low sound range are significantly decreased while changes in the features in the high and mid sound ranges are not significant.

Therefore, a signal processing device 100 according to one embodiment of the present disclosure is also applicable to canal type earphones, so that the signal processing device 100 estimates, by utilizing the output of comparative sounds, a frequency feature of the earphone in the state of being worn and corrects the audio signals on the basis of the estimation, thereby making it possible for a user to appropriately listen to reproduced sounds even in case where the ear duct is incompletely sealed with the earphone. For example, in case it is found that such a significant defect in the feature in the low sound range occurs due to the incomplete sealing of the ear duct with the earphone, the signal processing device 100 outputs to the earphone a signal having been subjected to a correction process to reinforce the sounds in the low sound ranges, thereby making it possible for a user to appropriately listen to reproduced sounds.

The signal processing described above is also applicable to portable phones and multifunctional portable phones (hereinafter, collectively referred to as portable phones) as targets of correction. The reference speaker may be a built-in speaker provided in the portable phone. The portable phone internally includes a memory and a processing section such a DSP (Digital Signal Processer), and is capable of storing frequency features of the built-in (accessary) speaker in the memory. In this case, the signal processing is performed in such a way that the target for the correction process is a predetermined speaker (for example a bone conduction speaker) connected to an audio output of the portable phone. The signal processing is also applicable to a case where the correction process is carried out for a phone receiver built in a main body of the portable phone as a bone conduction speaker, so that the correction process is performed in consideration of an attaching position preferable to a user.

Figure 6:
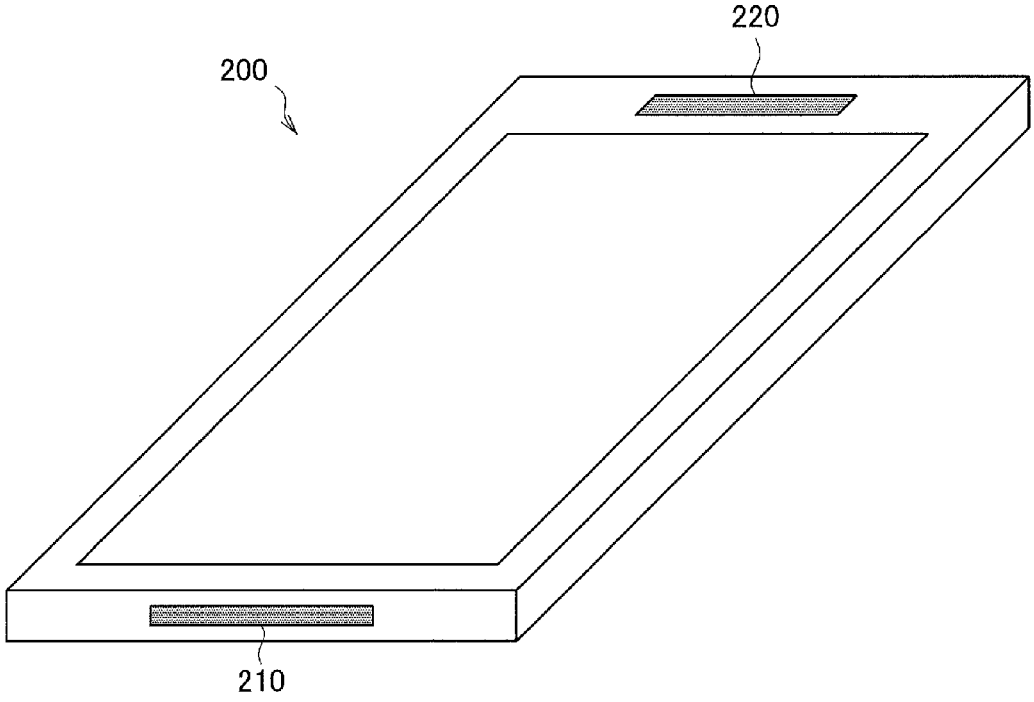
FIG. 6 is an explanatory view of one exemplary outer appearance of a mobile phone 200.

FIG. 6 is an explanatory view illustrating one exemplary outer appearance of a portable phone 200. The portable phone 200 as illustrated in FIG. 6 includes a speaker 210 and a phone receiver 220. For example, in case where a feature of the phone receiver 220 is to be corrected, the portable phone 200 is configured to store frequency features of the speaker 210 serving as a reference speaker, especially frequency features that the speaker 210 have when a user attaches the portable phone 200 to a user's ear for communication. The storing of the frequency features of the speaker 210 may be carried out by use of a memory, a DSP, or the like.

In order to communicate by holding the portable phone 200 to an ear, the user of the portable phone 200 holds the portable phone 200 at a position preferable to the user. The user performs comparative evaluation for acoustic pressures by comparing a sound outputted from the speaker 210 and a sound outputted from the phone receiver 220. The comparative evaluation of acoustic pressures is carried out by the portable phone 200 by performing the series of operations as described above. The comparative evaluation of acoustic pressures makes it possible to output appropriate sounds from the phone receiver 200 regardless of the fact that the position preferable to a user is different among users of the portable phone 200.

The correction process based on a similar comparative evaluation of acoustic pressures by use of the portable phone 200 is also applicable to a case where the target of the correction is a bone conduction speaker 20 provided externally. In order to correct a feature of such a bone conduction speaker 20, the portable phone 200 is configured to store frequency features of the speaker 210 serving as a reference speaker, especially, frequency features that the speaker 210 has when the portable phone 200 is placed, for example, at a position on a desk and in a distance of 50 cm from a user.

The user of the bone conduction speaker 20 holds the bone conduction speaker 20 at an attaching position, which the user considers is suitable for the user. The user performs the comparative evaluation of acoustic pressures by comparing a sound outputted from the speaker 210 placed in a distance substantially equivalent to the above-mentioned distance (for example, approximately 50 cm), and a sound outputted from the bone conduction speaker 20. The comparative evaluation of the acoustic pressures is carried out by the portable phone 200 by performing the series of operations as described above. By the comparative evaluation of the acoustic pressure, it is possible to output appropriate sounds from the bone conduction speaker 20 regardless of the fact that the position that a user considers is appropriate as the position to place the bone conduction speaker 20 is different among users.

The output of the sounds is not limited to the double-system sound output, on which the above-described embodiments are based by providing one sound output system for reference and one sound output system for the speaker to be corrected. For example, a signal processing device 100 may be configured to perform the comparison by employing a triple-system sound output by providing two sound output systems for reference and one sound output system for a speaker to be corrected. Such a signal processing device 100 can perform the estimation of frequency feature by choosing a more probable reference sound from between the reference sounds.

2. Conclusion

As described so far, one embodiment of the present disclosure provides a signal processing device 100 for correcting output to a speaker to be corrected (for example a bone conduction speaker), the signal processing device 100 being configured to cause a user to compare an acoustic pressure from a reference speaker and an acoustic pressure from the speaker to be corrected, obtain a result of comparison from the user, and correct, based on the result of comparison, the output to the speaker to be corrected.

For a speaker such as a bone conduction speaker for providing sounds to a user wearing the speaker by attaching the speaker to a body of the user, a signal processing device 100 according to one embodiment of the present disclosure makes it possible for the speaker to perform appropriate correction of sounds or music, which otherwise vary or varies according to an attaching position of the speaker. Thereby the signal processing device 100 makes it possible for the speaker to provide the user with appropriate sounding in consideration of the attaching position arbitrarily selected by the user to attach the speaker.

Especially for a reproducing system having a non-aerial conduction input, such as a bone conduction speaker, a signal processing device 100 according to one embodiment of the present disclosure makes it possible to perform appropriate correction of sounds or music, which otherwise vary or varies according to an attaching position of the non-aerial conduction input. Thereby the signal processing device 100 makes it possible for the reproducing system to provide the user with appropriate sounding in consideration of the attaching position arbitrarily selected by the user to attach the speaker.

A signal processing device 100 according to one embodiment of the present disclosure makes it possible for the user of the speaker that, by using a speaker to be corrected, which is attached to an attaching position chosen by a user of the speaker, the user of the speaker can listen to appropriate sounding or music with desirable features as designed. Moreover, a signal processing device 100 according to one embodiment of the present disclosure performs such evaluation process of the speaker to be corrected that acoustic pressure evaluation can be easily and surely performed by reproducing reference sounds (comparative sounds) repeatedly, thereby making it possible to obtain an appropriate correction coefficient.

A signal processing device 100 according to one embodiment of the present disclosure can perform correction of a speaker in such a way that the speaker to be corrected can provide a user with reproduced sounds with desired features, regardless of differences among individual users wearing the speaker, and attaching positions, which may be varied even for the same user.

It should be noted that the present disclosure is not limited to the above-described examples in which the correcting section 130 included in the signal processing device 100 performs the correction of the audio signal on the basis of the result of the comparison evaluation performed by the signal processing device 100. For example, a correcting section 130 may be provided in a device other than the signal processing device 100, so that the correcting section 130 receives a correction signal generated by the signal processing deice 100 and corrects, based on the correction signal, the audio signal to be supplied to the bone conduction speaker 20.

Steps in processes executed by devices in this specification are not necessarily executed chronologically in the order described in a sequence chart or a flow chart. For example, steps in processes executed by devices may be executed in a different order from the order described in a flow chart or may be executed in parallel.

Further, a computer program can be created which causes hardware such as a CPU, ROM, or RAM, incorporated in each of the devices, to function in a manner similar to that of structures in the above-described devices. Furthermore, it is possible to provide a recording medium having the computer program recorded thereon. Moreover, by configuring respective functional blocks shown in a functional block diagram as hardware, the hardware can achieve a series of processes.

It should be understood by those skilled in the art that various modifications, combinations, sub-combinations and alterations may occur depending on design requirements and other factors insofar as they are within the scope of the appended claims or the equivalents thereof.

In addition, the effects described in the present specification are merely illustrative and demonstrative, and not limitative. In other words, the technology according to the present disclosure can exhibit other effects that are evident to those skilled in the art along with or instead of the effects based on the present specification.

Additionally, the present technology may also be configured as below.

(1) A signal processing device including:

a first reproduced sound outputting section configured to cause a first reproduced sound providing section to provide a first reproduced sound;

a second reproduced sound outputting section configured to cause a second reproduced sound providing section to provide a second reproduced sound;

a comparison result obtaining section configured to obtain a result of comparison between the first reproduced sound and the second reproduced sound; and a correcting section configured to generate, based on the obtained result of comparison, a signal for correcting an output feature of the second reproduced sound from the second reproduced sound outputting section.

(2) The signal processing device according to (1), wherein the result of comparison obtained by the comparison result obtaining section is a result of comparison between the first reproduced sound and the second reproduced sound in terms of an acoustic pressure.

(3) The signal processing device according to (1) or (2), wherein the first reproduced sound outputting section and the second reproduced sound outputting section output the first reproduced sound and the second reproduced sound a predetermined number of times alternatively.

(4) The signal processing device according to (3), wherein the first reproduced sound outputting section and the second reproduced sound outputting section output the first reproduced sound and the second reproduced sound with a predetermined interval.

(5) The signal processing device according to any one of (1) to (4), wherein the first reproduced sound provided by the first reproduced sound outputting section and the second reproduced sound provided by the second reproduced sound outputting section have a same frequency.

(6) The signal processing device according to any one of (1) to (5), wherein the correcting section generates, by using correcting values stored in advance, the signal for correcting the output feature of the second reproduced sound.

(7) The signal processing device according to any one of (1) to (5), wherein the correcting section generates, based on the result of comparison, a signal for correcting an acoustic pressure of the second reproduced sound.

(8) The signal processing device according to any one of (1) to (7), wherein the first reproduced sound outputting section and the second reproduced sound outputting section output the first reproduced sound or the second reproduced sound plural times in each of which central frequencies are different.

(9) The signal processing device according to any one of (1) to (7), wherein the central frequencies which are adjacent to each other have an interval of less than 1 octave.

(10) The signal processing device according to any one of (1) to (9), wherein the second reproduced sound providing section is a non-aerial conduction device.

(11) The signal processing device according to (10), wherein the second reproduced sound providing section is a bone conduction speaker.

(12) A signal processing method including:

causing a first reproduced sound providing section to provide a first reproduced sound;

causing a second reproduced sound providing section to provide a second reproduced sound;

obtaining a result of comparison between the first reproduced sound and the second reproduced sound; and generating, based on the obtained result of comparison, a signal for correcting an output feature of the second reproduced sound.

(13) A computer program for causing a computer to perform:

causing a first reproduced sound providing section to provide a first reproduced sound;

causing a second reproduced sound providing section to provide a second reproduced sound;

obtaining a result of comparison between the first reproduced sound and the second reproduced sound; and generating, based on the obtained result of comparison, a signal for correcting an output feature of the second reproduced sound.

What is claimed is:

1. An audio signal processing device, comprising:

one or more processors configured to:

cause a first speaker to output a first reproduced sound;

cause a second speaker to output a second reproduced sound;

obtain a result of comparison between the first reproduced sound and the second reproduced sound; and execute, based on the obtained result of the comparison, signal processing to correct an output feature of the second reproduced sound, wherein the one or more processors are configured to cause the output of the first reproduced sound or the second reproduced sound plural times, each time at a different central frequency of the first reproduced sound or the second reproduced sound.

2. The audio signal processing device according to claim 1, wherein the result of the comparison obtained by the one or more processors is a result of comparison between a first acoustic pressure of the first reproduced sound and a second acoustic pressure of the second reproduced sound.

3. The audio signal processing device according to claim 1, wherein the one or more processors are further configured to output the first reproduced sound and the second reproduced sound a determined number of times alternatively.

4. The audio signal processing device according to claim 3, wherein the one or more processors are further configured to output the first reproduced sound and the second reproduced sound with a determined interval.

5. The audio signal processing device according to claim 1, wherein the one or more processors are further configured to output the first reproduced sound and the second reproduced sound at a same frequency.

6. The audio signal processing device according to claim 1, wherein the one or more processors are further configured to execute, based on correcting values stored in advance, the signal processing to correct the output feature of the second reproduced sound.

7. The audio signal processing device according to claim 1, wherein the one or more processors are further configured to execute, based on the result of the comparison, the signal processing to correct an acoustic pressure of the second reproduced sound.

8. The audio signal processing device according to claim 1, wherein central frequencies of the first reproduced sound or the second reproduced sound which are adjacent to each other have an interval of less than 1 octave.

9. The audio signal processing device according to claim 1, wherein the second speaker is a non-aerial conduction device.

10. The audio signal processing device according to claim 9, wherein the second speaker is a bone conduction speaker.

11. An audio signal processing method, comprising:

causing a first speaker to output a first reproduced sound;

causing a second speaker to output a second reproduced sound;

obtaining a result of comparison between the first reproduced sound and the second reproduced sound; and executing, based on the obtained result of the comparison, signal processing for correcting an output feature of the second reproduced sound, wherein the first reproduced sound or the second reproduced sound is output plural times, each time at a different central frequency of the first reproduced sound or the second reproduced sound.

12. A non-transitory computer-readable medium recorded with a set of computer-executable instructions to cause a computer to execute operations, the operations comprising:

causing a first speaker to output a first reproduced sound;

causing a second speaker to output a second reproduced sound;

obtaining a result of comparison between the first reproduced sound and the second reproduced sound; and executing, based on the obtained result of the comparison, signal processing for correcting an output feature of the second reproduced sound, wherein the first reproduced sound or the second reproduced sound is output plural times, each time at a different central frequency of the first reproduced sound or the second reproduced sound.

* * * * *